US006185923B1

(12) United States Patent
Elias

(10) Patent No.: US 6,185,923 B1
(45) Date of Patent: Feb. 13, 2001

(54) ADJUSTABLE LENGTH EXPANSIBLE CHAIN

(75) Inventor: Jacob Joseph Elias, Flusing, NY (US)

(73) Assignee: Genal Strap, Inc., Long Island City, NY (US)

( * ) Notice: Under 35 U.S.C. 154(b), the term of this patent shall be extended for 0 days.

(21) Appl. No.: 09/411,223

(22) Filed: Oct. 4, 1999

(51) Int. Cl.[7] ..... F16G 13/24

(52) U.S. Cl. ..... 59/79.1; 59/79.1; 59/79.3; 59/80; 59/93

(58) Field of Search ..... 59/79.1, 79.3, 59/80, 93

(56) References Cited

U.S. PATENT DOCUMENTS

| | | | | |
|---|---|---|---|---|
| 3,705,490 | * | 12/1972 | Ripley | 59/80 |
| 3,786,629 | | 1/1974 | Rieth | 59/79 |
| 3,924,418 | * | 12/1975 | Burkle, Jr. | 59/80 |
| 3,994,126 | * | 11/1976 | Rieth | 59/79.1 |
| 4,096,688 | * | 6/1978 | Rieth | 59/79.1 |
| 4,723,406 | | 2/1988 | Ripley | 59/79 |

* cited by examiner

*Primary Examiner*—David Jones
(74) *Attorney, Agent, or Firm*—Robert L. Epstein; Harold James; James & Franklin, LLP

(57) ABSTRACT

Significant length adjustment is achieved in a facile manner in connection with an expansible chain comprising upper and lower layers of links, each link extending generally laterally of said chain and arranged longitudinally to define the length of said chain, the links of said upper layer having a dimension in the direction of said chain length greater than that of the links of said lower layer so that when said chain is contracted adjacent links of said upper layer engage one another and gaps are produced between the links of said lower layer, an end of said chain being slidably telescopable into a housing having an articulately mounted retaining member which when disengaged from said chain end permits telescoping movement of said chain end with respect to said housing to adjust the effective chain length and which when moved to retaining position engages said chain in the gap between the adjacent links of said lower layer, thereby fixing said chain within said housing without distortion of or damage to said chain.

3 Claims, 3 Drawing Sheets

ADJUSTABLE LENGTH EXPANSIBLE CHAIN

BACKGROUND OF THE INVENTION

The invention relates to the facile achievement of length adjustment of an expansible chain of particular type.

Expansible chains are in common use as watch bands, identification bracelets or similar articles of jewelry. They must be fitted to the wrist of the user if they are to function satisfactorily, and the girth of the user's wrist varies widely from person to person. In addition, different individuals may have different desires with respect to snugness of the chain on the wrist. Further, the comfort attendant upon the use of a bracelet of given length by a particular person may vary from time to time—what is pleasantly snug in winter may be uncomfortably tight in summer, or the user's wrist may grow or shrink. For the retailer all of this presents a potential inventory problem—to stock a given bracelet style in many different sizes in order to accommodate all or most potential customers involves a significant investment and complete stocking of all sizes of all styles of bracelets is impractical, loss of potential sales may result, or else there is incentive to try to sell the customer a bracelet that is not of optimum length, possibly leading to customer dissatisfaction and loss of future sales.

Various constructions have been suggested in the past in an attempt to meet these problems. Most of them involve relatively complicated structures, such as the use of removable and replaceable push pins, which as a practical matter can be manipulated only by a skilled jeweler, and even then requiring an appreciable period of time in which to make the requisite adjustments. The problem is exacerbated by the fact that a given chain fitting in a store may involve several trials of different chain lengths before the final length is selected. Moreover, once the chain length is selected and the chain is purchased subsequent chain length adjustment by the purchaser is impractical.

Another approach adopted in connection with an expansible mesh chain formed of closely intertwined resilient wire lengths is to provide a housing into which an end of such a chain can be telescoped and providing that housing with a retaining member which, when the mesh chain is inserted into the housing to desired degree, may then be forced into the mesh chain to retain it is position. However, this has a serious disadvantage in that when the retainer member thus engages the chain it distorts the latter, thus making readjustment deleterious to the mesh.

Another approach has been to adjustably overlap two sections of the chains, sometimes within a housing and sometimes not, with means secured to one chain end which can engage the other chain end. When watch bands are involved housings have been provided at the ends of the watch with the entire bottom walls of the housing pivotal between chain engaging and chain releasing positions and having a part adapted to be received in gaps between adjacent links. The overlapping approach has the distinct disadvantage of thickening the band where the overlapping takes place, and the housing attached to the watch has the disadvantage of decreasing the effective length of the flexible chain, creating a visual discontinuity at the ends of the watch, where such a discontinuity would be most visible when on the wrist of the wearer. In addition, because the entire bottom wall of the housing is pivotable properly positioning the chain end within that housing is awkward and sometimes difficult.

One known type of expansible chain, disclosed in Reith U.S. Pat. No. 3,786,629 of Jan. 22, 1974 and entitled "Expansible Linkage For Use In Making A Watch Band Or Similar Article", has two layers of overlapping staggered links resiliently urged toward one another in the direction of shortening the chain length, with the outer layer of links having a greater dimension in the direction of the chain length than the links of the inner layer, so that when the chain is fully contracted the links of the outer layer engage one another and gaps remain between the links of the lower layer.

A prime object of the present invention is to provide means for adjusting the length of an expansible chain which is easy, rapid, may be readily accomplished by the jeweler or by the user, and does not adversely affect the expansible chain itself.

A further object of the present invention is to provide means for readily adjusting the length of an expansible chain comprising upper and lower layers of links wherein gaps normally exist between the links of the lower layer when the chain is in contracted condition which adjustment does not in any way adversely affect the chain structure itself or its appearance.

A further object of the present invention is to provide means for adjusting the length of an expansible chain over a range capable of accommodating all or almost all of the length potentially met with in the selling of chains to the general public.

To these ends a housing comprising a top wall, side walls and inwardly extending bottom wall sections is so shaped as to produce a recess into which one end of the chain of the above construction may be slid, the inwardly extending bottom wall sections supporting the chain when slid thereinto and, with the other walls, producing a cross-section for the recess which closely corresponds with the cross-section of the chain, the housing being provided with an articulately mounted retaining member vertically moveable between the inwardly extending bottom wall sections and having a toothlike part attached to be received in one of the gaps between the links of the lower layer of the chain, thereby to retain the chain end in said housing. The housing is symmetrically mounted so as to receive ends of chain lengths into opposite ends of the housing for length adjustability, the length of said housing for each chain end preferably being such as to receive at least three, and preferably at least four, sets of said upper and lower links beyond the toothlike part of the corresponding retainer member. As a result, merely by moving that retaining member between its chain engaging and chain releasing positions one may easily achieve extensive adjustment of the length of the chain that extends outside of the housing without distortion of or damage to the chain.

DESCRIPTION OF THE PREFERRED EMBODIMENT

Figure 1:
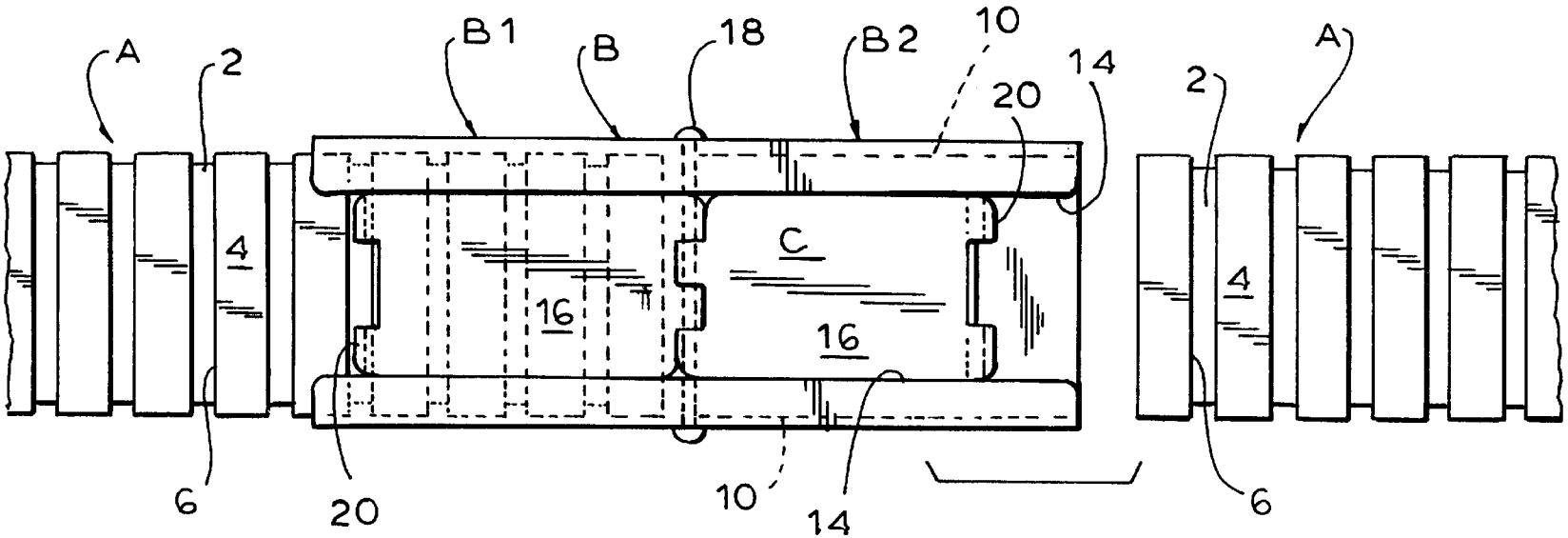
FIG. 1 is a bottom plan view of a preferred embodiment of the present invention showing the end of the left-hand chain section, fully received within the chain-receiving housing and there engaged by the retaining member and showing the end of the right-hand chain section ready to be telescoped into the housing.

The present invention comprises the combination of a particular type of expansible chain generally designated "A" and a housing assembly generally designated "B" adapted to adjustably receive and retain ends of the chain thereinto.

Expansible chain A comprises an upper layer of links 2 and a lower layer of links 4, those links in each layer extending generally laterally of the chain and arranged longitudinally to define the length of said chain. The two chain section ends illustrated in the drawings may be part of one continuous chain, as in the case of a bracelet, or may be ends of two separate lengths of chain, as when the other ends of those lengths are connected to a watch or an identification plate. The upper layer links 2 have a dimension in the direction of the chain length which is greater than that of the lower layer links 4 and consequently when the resilient mechanism incorporated within the chain causes the chain to move to its fully contracted position adjacent upper layer links 2 engage one another and limit the degree to which the chain will contract, as a result of which gaps 6 are formed between each adjacent pair of lower layer links 4. As has been pointed out, this type of expansion linkage has been known and on the market for many years and is disclosed in Reith U.S. Pat. No. 3,786,629 of Jan. 22, 1974.

The gaps 6 between the lower layer link 4 are a pre-existing feature of this type of expansible chain. In accordance with the present invention advantage is taken of those pre-existing gaps 6 to enable chain length adjustments without damage to or distortion of the chain itself.

The housing assembly B comprises a top wall 8, side walls 10 and inwardly extending bottom wall sections 12 the ends of which are spaced from one another as at 14, thereby to define a recess of cross sectional size and shape corresponding generally to the cross-section of the chain itself such that the end of one chain layer A can be telescopically slid thereinto. Pivotally mounted in the housing B for generally vertical movement between the bottom wall section ends 14 is a retaining member C defined by a plate 16 of a width such as to pass through the space 14 between the ends of the inwardly extending bottom wall sections 12, that plate 16 being pivotally mounted at one end on a pin 18 extending transversely of the housing B, the plate 16 having at its free end one or more upwardly extending teeth 20. The length of the plate 16 is such that the teeth 20 are located relatively close to the open end of the housing B. The pin 18 with the retaining member C mounted thereon is so located in the internal space of the housing B as to constitute a stop limiting the degree to which the chain end may be telescoped inwardly. The retaining member C is moveable between an adjusting position shown in solid line at the right-hand side of FIG. 2 and in broken lines at the left-hand side thereof and a retaining position shown in FIG. 3. In the adjusting position, in which the retaining member C is pivoted downwardly, the tooth 20 is disengaged from chain A, permitting the chain to be relatively freely telescoped in and out of the housing. While in the retaining position, in which the retaining member is pivoted upwardly, the tooth 20 is received in a selected gap 6 between two adjacent lower layer links 4, thereby to constitute the only element which locks the chain against telescoping movement within the housing B.

Figure 2:
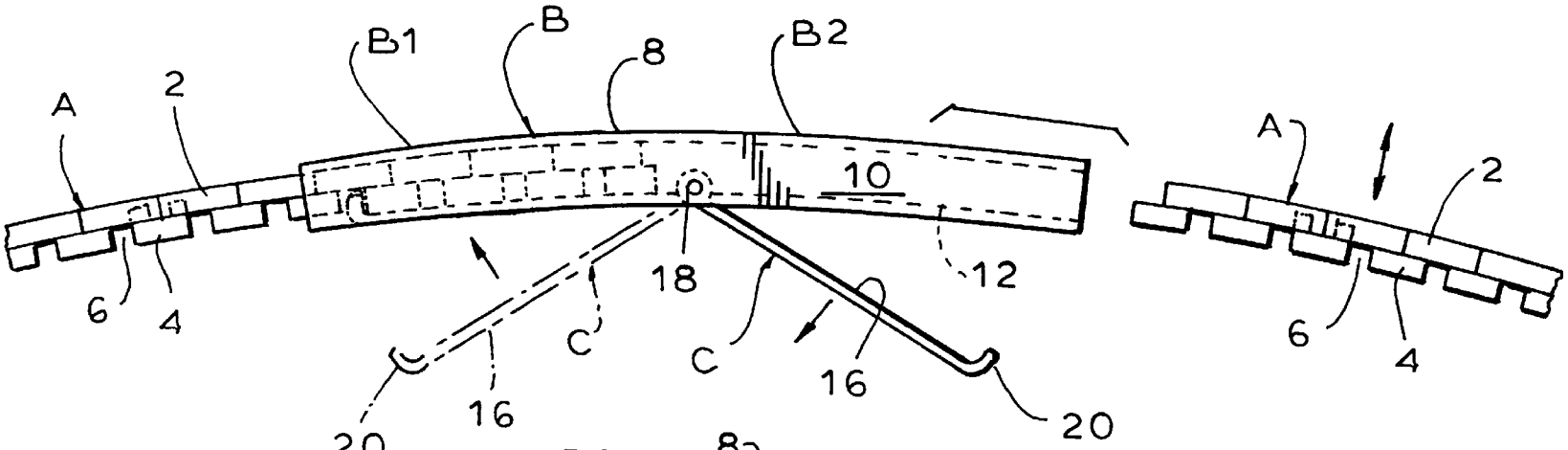
FIG. 2 is a side elevational view corresponding to FIG. 1, showing in broken lines the left-hand retaining member in its chain-releasing position and showing the right-hand retaining member in solid line in that chain-releasing position.
Figure 3:
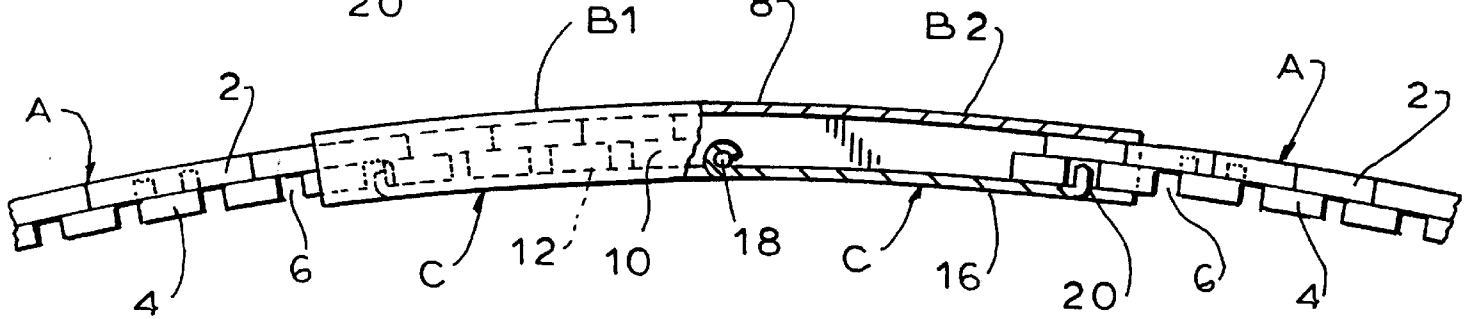
FIG. 3 is a view similar to FIG. 2 but with the right-hand section broken to show the right-hand chain end secured within the housing only to the length of a single chain link.
Figure 4:
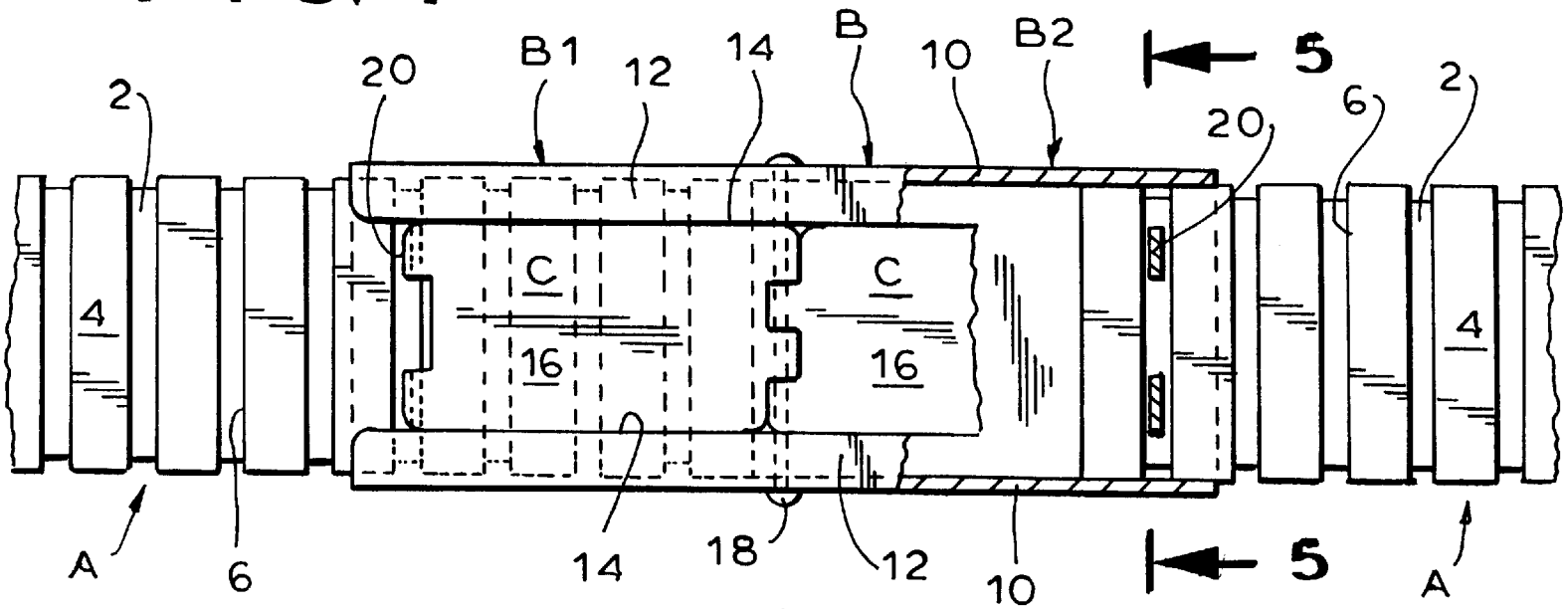
FIG. 4 is a top plan view, partially broken away, of the arrangement of FIG. 3.
Figure 5:
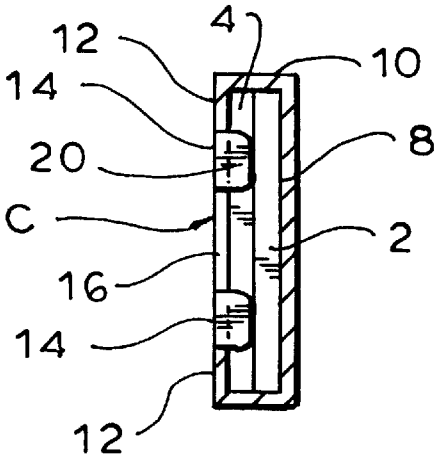
FIG. 5 is a cross sectional view taken along the line 5—5 of FIG. 4.

The housing B is designed to be located midway of the overall length of the chain. Hence when the chain is used with a watch the housing B will be worn on the underside of the wearer's wrist, where it cannot detract from or clash with the appearance of the watch or the flexibility of the chain where that chain is most visible. When the housing B is used to receive the two ends of a continuous chain it may be worn either on top of the user's wrist or on the bottom of the wrist, depending upon the aesthetic choice of the user. Hence the housing B receives at each of its opposite ends the end of a chain length. It is here illustrated as being formed of two longitudinally arranged sections B1 and B2, each with its own retaining member C. In each section, B1 or B2, the tooth 20 of the retaining member C is located close to the outer end of the housing and sufficiently spaced from the pin 18 so that at least three, and preferably four or more, sets of upper and lower link layers 2 and 4 can be slid into the housing B from each end thereof. In the drawings, the chain A is telescoped into the left-hand housing B1 as far as it can go, four sets of upper and lower links 2 and 4 being there received and with the tooth 20 of the left-hand retaining member C being received in the gap 6 between the fourth and fifth of the lower layer links 4. FIGS. 1 and 2 show the other expansible chain end outside the right-hand section B2 end ready to be telescoped thereunto, while FIGS. 3–5 show that expansible chain ends telescoped minimally into the right-hand housing section B2, with the tooth 20 of right-hand retaining member C being received in the gap 6 between the first and second of the lower layer links 4. That showing represents the extremes of adjustability for the particular embodiment here illustrated, and it will be understood that there are two non-illustrated intermediate stages of length adjustment for each of the housing sections B1 and B2 with tooth 20 of the applicable retaining member C being received in the gaps 6 between the second and third or third and fourth of the lower layer links respectively.

With this construction when a customer seeks to purchase a band the salesman can fit the band to the customer's wrist merely by lifting one or both of the retaining members C to their adjusting position, freely sliding the chain end into and out from the housing B to produce a chain length of the customer's desire and then moving those retaining member or members to retaining position. The inwardly extending bottom walls 12 support the chain end in the housing, thus facilitating the length adjustment. The adjustment operations are simple, rapid and require no tools so that a trial-and-error approach involving testing different lengths for the customer's approval by a salesman with no particular mechanical skill is entirely feasible. With a housing B which, as here illustrated will on each side accommodate at least three, and preferably at least four, sets of upper and lower layer links 2 and 4, sufficient adjustability is achieved to cover the usual range of bracelet lengths experienced under normal circumstances. Moreover, the mode of manipulation to achieve chain length adjustment is so simple, involving only lowering the retaining member C, telescoping the chain A in or out of the housing B to desired degree, and then lifting the retaining member C, that length adjustments can readily be accomplished by the user, as when his wrist size may change or changes in climate may dictate a longer or shorter bracelet for optimum comfort or function.

The housing B, of course, may have its top wall 8, as well as its side wall 10 and bottom walls 12, appropriately ornamented and shaped so as to enhance the appearance of the overall bracelet or the like.

While but a single embodiment of the present invention has been here disclosed, it will be apparent that many variations may be made therein, all within the scope of the invention as defined in the following claims.

I claim:

1. In combination, an expansible chain comprising upper and lower layers of links, each link extending generally laterally of said chain and arranged longitudinally to define a length of said chain, the links of said upper layer having a dimension in the direction of said chain length greater than that of the links of said lower layer, and resilient means connected between said links and operative to urge said links toward one another and to urge adjacent links of said upper layer into engagement, thereby to decrease the length of said chain and to produce gaps between the links of said lower layer when the links of said upper layer engage one another, and a housing for telescopingly receiving one end of said chain, said housing comprising a top wall, side walls and inwardly extending bottom wall sections producing a recess having a cross-section substantially corresponding to that of said chain and into which said end of said chain may be slid, said bottom wall sections being substantially spaced from one another laterally of said chain, and means for articulately mounting said retaining member in said housing for movement generally vertically of said housing, said retaining member passing through the space between the inwardly extending bottom wall sections, said retaining member mounting means being so located as to define a stop limiting movement of said chain end into said recess, said retaining member having an upwardly extending part adapted to be received in one of the gaps between the links of said lower chain layer, said retaining member being moveable between a lower position free of said chain ends and an upper position in which said retaining member part is received as described, thereby to retain said chain end in said housing, the length of said housing being such as to receive at least three sets of said upper and lower links therewithin beyond the upturned part of said retaining member, thereby to readily permit extensive adjustment of the length of said chain that extends outside of said housing without distortion or damage to said chain, said housing slidably receiving a chain section at each end thereof and being provided with a pair of said pivotally mounted retainer members extending in opposite directions so as to be engageable with each of said chain sections respectively when the latter are inserted into said housing from opposite ends thereof.

2. The combination of claims 1, in which the depth of the recess in said housing is such as to receive at least three sets of said upper and lower links therewithin beyond the upturned portion of said retainer members.

3. The combination of claim 2, in which the depth of the recess in said housing is such as to receive at least four sets of said upper and lower links therewithin beyond the upturned portion of said retainer members.

* * * * *